US009435610B2

(12) United States Patent
Silvers et al.

(10) Patent No.: US 9,435,610 B2
(45) Date of Patent: Sep. 6, 2016

(54) PROJECTILE-WEAPON RETICLE WITH HOLDOVER AIMING FEATURES FOR MULTIPLE PROJECTILE VELOCITIES

(71) Applicant: Leupold & Stevens, Inc., Beaverton, OR (US)

(72) Inventors: Robert Silvers, Marshfield, MA (US); Martin Koornneef, Beaverton, OR (US); Raymond G. Brock, Beaverton, OR (US); Stephen R. Hodge, North Plains, OR (US); Richard Bradley Brumfield, Wilsonville, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 14/695,266

(22) Filed: Apr. 24, 2015

(65) Prior Publication Data

US 2015/0354921 A1 Dec. 10, 2015

Related U.S. Application Data

(63) Continuation of application No. 14/085,759, filed on Nov. 20, 2013, now Pat. No. 9,038,307, which is a continuation-in-part of application No. 29/437,798, filed on Nov. 20, 2012, now Pat. No. Des. 709,588.

(60) Provisional application No. 61/729,308, filed on Nov. 21, 2012.

(51) Int. Cl.
*F41G 1/38* (2006.01)

(52) U.S. Cl.
CPC ..... *F41G 1/38* (2013.01)

(58) Field of Classification Search
USPC ..... 42/122, 11; 359/422, 424
See application file for complete search history.

(56) References Cited

U.S. PATENT DOCUMENTS

| | | | | |
|---|---|---|---|---|
| 1,190,121 | A * | 7/1916 | Critchett | 42/119 |
| 2,464,521 | A * | 3/1949 | McCall | 33/297 |
| 3,058,391 | A * | 10/1962 | Leupold | 359/422 |
| 3,190,003 | A * | 6/1965 | O'Brien | 33/297 |
| 3,297,389 | A * | 1/1967 | Gibson | 359/424 |
| 3,392,450 | A * | 7/1968 | Herter et al. | 42/122 |

(Continued)

FOREIGN PATENT DOCUMENTS

| | | |
|---|---|---|
| DE | 2000614 | 7/1971 |
| WO | WO-2012/100015 | 7/2012 |
| WO | WO-2013/106280 | 7/2013 |

OTHER PUBLICATIONS

Military Surplus Collectors Forums, "Japanese Ammunition and Rifle Testing," http://www.milsurps.com/showthread.php?t=31059, dated May 14, 2011, visited Oct. 30, 2012.

(Continued)

*Primary Examiner* — Michael David
(74) *Attorney, Agent, or Firm* — Stoel Rives LLP; Robert R. Teel

(57) ABSTRACT

A reticle of a projectile-weapon aiming system such as a riflescope includes first and second series of secondary aiming marks spaced apart below a primary aiming point, the first and second series providing holdover aiming points for regularly incrementing target distances for respective subsonic and supersonic .300 AAC Blackout ammunition, or other differing types of ammunition, without requiring adjustment of the optics or settings of the aiming system.

26 Claims, 4 Drawing Sheets

(56) References Cited

U.S. PATENT DOCUMENTS

| | | | | |
|---|---|---|---|---|
| 3,431,652 | A * | 3/1969 | Leatherwood | 42/122 |
| 3,492,733 | A * | 2/1970 | Leatherwood | 42/122 |
| 3,540,256 | A * | 11/1970 | Thompson | 72/299 |
| 3,591,537 | A * | 7/1971 | Squire et al. | 25/252 |
| 3,826,012 | A * | 7/1974 | Pachmayr | 42/122 |
| 3,948,587 | A * | 4/1976 | Rubbert | 356/21 |
| 4,248,496 | A * | 2/1981 | Akin et al. | 356/3 |
| 4,403,421 | A * | 9/1983 | Shepherd | 42/122 |
| 6,032,374 | A * | 3/2000 | Sammut | 42/122 |
| 6,269,581 | B1 * | 8/2001 | Groh | 42/122 |
| 6,357,158 | B1 * | 3/2002 | Smith, III | 42/122 |
| 6,591,537 | B2 | 7/2003 | Smith | |
| 7,100,320 | B2 | 9/2006 | Verdugo | |
| 7,185,455 | B2 * | 3/2007 | Zaderey | 42/122 |
| D567,326 | S * | 4/2008 | Pride et al. | D22/109 |
| D589,581 | S | 3/2009 | Peters et al. | |
| 7,603,804 | B2 | 10/2009 | Zaderey et al. | |
| 7,654,029 | B2 * | 2/2010 | Peters et al. | 42/111 |
| 7,793,456 | B1 * | 9/2010 | Lacorte | 42/122 |
| 7,832,137 | B2 * | 11/2010 | Sammut et al. | 42/111 |
| 7,937,878 | B2 | 5/2011 | Sammut et al. | |
| D651,682 | S | 1/2012 | Beckett et al. | |
| 8,353,454 | B2 * | 1/2013 | Sammut et al. | 235/404 |
| D679,776 | S * | 4/2013 | Bracken et al. | D22/109 |
| D679,777 | S * | 4/2013 | Bracken et al. | D22/109 |
| D680,187 | S * | 4/2013 | Bracken et al. | D22/109 |
| 8,656,630 | B2 * | 2/2014 | Sammut | 42/122 |
| D709,588 | S | 7/2014 | Silvers et al. | |
| D716,409 | S | 10/2014 | Mikroulis | |
| D716,905 | S | 11/2014 | Beckett et al. | |
| D720,033 | S | 12/2014 | Mikroulis | |
| 9,038,307 | B2 * | 5/2015 | Silvers et al. | 42/122 |
| 9,068,799 | B1 | 6/2015 | Wu | |
| 2005/0005495 | A1 | 1/2005 | Smith | |
| 2005/0188601 | A1 * | 9/2005 | Verdugo | 42/130 |
| 2006/0010757 | A1 | 1/2006 | Smith, III | |
| 2006/0026887 | A1 | 2/2006 | Verdugo | |
| 2006/0260171 | A1 * | 11/2006 | Cole et al. | 42/122 |
| 2007/0044364 | A1 * | 3/2007 | Sammut et al. | 42/122 |
| 2008/0098640 | A1 * | 5/2008 | Sammut et al. | 42/122 |
| 2009/0199451 | A1 * | 8/2009 | Zaderey et al. | 42/122 |
| 2009/0235570 | A1 * | 9/2009 | Sammut et al. | 42/122 |
| 2012/0186130 | A1 * | 7/2012 | Tubb | 42/122 |
| 2013/0033746 | A1 * | 2/2013 | Brumfield | 359/401 |
| 2013/0047485 | A1 * | 2/2013 | Tubb | 42/122 |
| 2014/0059915 | A1 * | 3/2014 | Sammut et al. | 42/122 |
| 2014/0123534 | A1 * | 5/2014 | Hodnett | 42/122 |
| 2014/0373424 | A1 * | 12/2014 | Silvers et al. | 42/122 |

OTHER PUBLICATIONS

Leghorn, Nick, The Truth About Guns, "Browe Combat Optic Copies Leupold's 300 AAC Blackout Reticle," http://www.thetruthaboutguns.com/2012/08/foghorn/browe-combat-optic-copies-leupolds-300-aac-blackout-reticle/, dated Aug. 30, 2012, visited Sep. 13, 2012.

Valdada, "QR-TS 3×25 30mm Tactical BDC .223 Scope Illuminated CQB reticule," http://www.valdada.com/3x25-30mm-qr-ts-bdc-223-scope-illuminated-cqb-reticule/, visited May 7, 2012.

Internet Archive, "U.S. Optics, Reticle Name: JPJ1," http://web.archive.org/web/20120912020632/http://www.usoptics.com/scope/product/viewlargeimage/id/664, archived Sep. 12, 2012, visited Jan. 6, 2014.

Internet Archive, "TA11SDO-CP ACOG—Trijicon, Inc.," http://web.archive.org/web/20110913034427/http://www.trijicon.com/na_en/products/product3.php?pid=TA11SDO-CP, archived Sep. 13, 2011, visited Jul. 17, 2015.

Ronin Tactical's New Corner Site, "SU-258/PVQ TA11SDO-CP: Trijicon ACOG 3.5×35 Scope, Dual Illuminated Red Horseshoe / Dot, M249 Ballistic Reticle, 9.0 MOA RMR Sight and LaRue Tactical Mount," http://ronintactical.blogspot.com/2015/05/su-258pvq-ta11sdo-cp-trijicon-acog.html, dated May 20, 2015, visited Aug. 12, 2015.

Kopas, Andrew D., "Handbook of Standard Reticle Patterns by Manufacturer," 67 pp., version 5, dated Jan. 3, 2009.

U.S. Appl. No. 29/493,632, filed Jun. 11, 2014.

* cited by examiner

FIG. 1
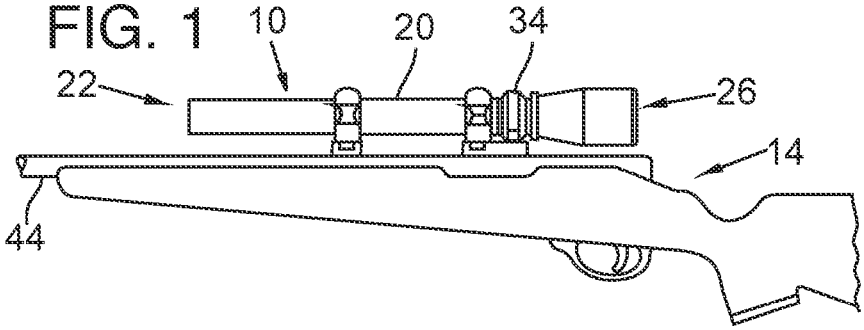
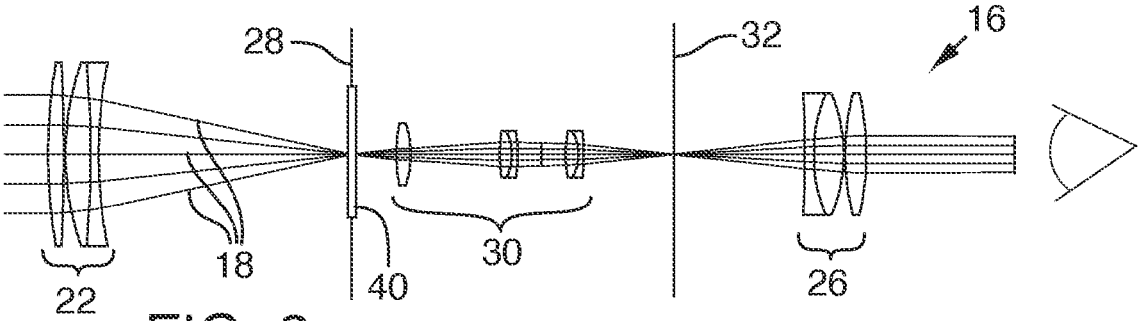
FIG. 2

PROJECTILE-WEAPON RETICLE WITH HOLDOVER AIMING FEATURES FOR MULTIPLE PROJECTILE VELOCITIES

RELATED APPLICATIONS

The present application is a continuation of U.S. Non-Provisional patent application Ser. No. 14/085,759, filed Nov. 20, 2013; which is a continuation-in-part of U.S. Design patent application No. 29/437,798, filed Nov. 20, 2012, now U.S. Design Pat. No. D709,588, issued Jul. 22, 2014; and the '759 application claims benefit of U.S. Provisional Patent Application No. 61/729,308, filed Nov. 21, 2012. Each aforementioned application is hereby incorporated by reference in its entirety.

TECHNICAL FIELD

This application relates to projectile-weapon aiming systems such as riflescopes, to reticle configurations for projectile-weapon aiming systems, and to associated methods of compensating for ballistic characteristics.

BACKGROUND INFORMATION

Projectile-weapon aiming systems are discussed herein principally in the context of telescopic sights rigidly affixed to a weapon and commonly embodied as a riflescope. Riflescopes include reticles for aiming at locations indicated by a reticle aiming mark. A reticle aiming mark defines an aiming point at which a straight aiming line of sight intersects at a discrete distance (so-called range or target distance) a bullet or other projectile's curved trajectory. The curved trajectory is traversed by the projectile falling and decelerating while traveling from the weapon to the target location, and it depends on ballistic characteristics, such as projectile weight, drag, and initial velocity (e.g., muzzle velocity), and on other factors impacting external ballistics of an ammunition. Thus, the projectile, due to its curved trajectory, will intersect the aiming line of sight at one range and pass below or above it at other ranges. This necessitates the use of elevation adjustments to adjust the aiming line of sight for intersecting the curved trajectory at another target range.

Elevation adjustments in riflescopes are typically made by turning an adjustment mechanism of the riflescope to impart vertical movement of optical elements (as described, for example, in U.S. Pat. No. 3,297,389 of Gibson) or of the reticle (as described, for example, in U.S. Pat. No. 3,058,391 of Leupold), so that the aiming line of sight is accurately sighted-in at the range of the target. To adjust for the effect of crosswinds, riflescopes also typically include a separate adjustment mechanism for imparting horizontal movement to the optical elements or reticle. In yet other projectile-weapon aiming systems, the entire aiming device is adjusted relative to the weapon via an adjustable sight mount. In each type of adjustment device, adjustment of the elevation and windage is time consuming and may require the shooter to take his or her eyes off the target while manipulating the adjustment mechanisms.

There have been proposed numerous reticles and riflescopes designed to provide the shooter with a plurality of aiming marks for shooting at targets at various predetermined ranges, i.e., aiming marks producing line of sight/trajectory intersections at various target distances. Some of these include devices for approximating the range to the target. These riflescopes propose to eliminate the need to make elevation adjustments in the riflescope to compensate for bullet drop at different ranges. Instead, the shooter merely aims with one of several holdover aiming marks on the reticle spaced below the primary crosshair. Example riflescopes employing reticles to facilitate "holdover aiming" are described in U.S. Pat. No. 3,190,003 of O'Brien; U.S. Pat. No. 1,190,121 of Critchett; U.S. Pat. No. 3,392,450 of Herter et al.; U.S. Pat. Nos. 3,431,652 and 3,492,733 of Leatherwood; U.S. Pat. No. 6,032,374 of Sammut; U.S. Pat. No. 6,591,537 of Smith; U.S. Pat. No. 7,185,455 of Zaderey; and U.S. Pat. No. 7,603,804 of Zaderey et al. Most of these patents propose riflescopes providing a plurality of range-related aiming marks accompanied with aiming mark selection devices, the use of which depends on relative height of the image of a target of known or estimable height compared to the height of a feature in the reticle. These reticles are also designed with a single set of aiming marks corresponding to a single type of ammunition at a time. Shooting another type of ammunition having different ballistic characteristics necessitates adjustment of the optics or reticle.

U.S. Pat. No. 6,032,374 of Sammut and U.S. Pat. No. 6,591,537 of Smith propose reticles having a series of secondary aiming marks spaced below a primary aiming mark at predetermined intervals for compensating for bullet drop. These secondary aiming marks provide holdover aiming points, which the shooter selects based on the secondary aiming mark that most closely corresponds to the observed range. The secondary aiming marks of Sammut are evenly spaced, but a bullet's trajectory is parabolic, so Sammut requires preliminary collection of ballistic data to determine the range corresponding to each secondary aiming mark. The corresponding ranges determined by the collection of ballistic data are applicable only for the ballistics of particular ammunition for which data is collected. Furthermore, a shooter must either memorize the ranges that are empirically determined for various types of ammunition having different ballistic characteristics or refer to a worksheet where the ballistic data and corresponding ranges have been recorded.

Smith purports to provide secondary aiming marks for regular incremental ranges (typically 300, 400, 500, and 600 yards) in an attempt to eliminate the need, as with the device of Sammut, to refer to ballistics data or to memorize the ranges corresponding to the secondary aiming marks. However, the ranges of the secondary aiming marks of Smith are accurate only for a particular predetermined rifle and ammunition combination, referred to as the "ballistic factor." For ammunition having a ballistic factor different from the factor for which the reticle is designed, Smith proposes to apply a decal to the stock of the rifle or some other convenient location for reference in determining the irregular ranges at which the secondary aiming marks are to be used to aim the rifle.

U.S. Pat. No. 4,403,421 of Shepherd describes a two-reticle system including crosshairs located at a rear focal plane of a riflescope, and a secondary reticle located at the front focal plane and made of a polygonal-shaped transparent material. The secondary reticle is mounted in a manually rotatable mounting, to allow the reticle to be moved in and out of the field of view, and to allow the polygon to be rotated so that different reticle patterns on each of its faces are viewable. Shepherd describes that the secondary reticle may have different sets of range indicia marked on different faces of the reticle, in which the different sets of range indicia correspond to different families of bullets or different weights of bullets having different muzzle velocities. The different range scales are not simultaneously visible and require the user to rotate the reticle to select from the different patterns.

Several other patents for devices commonly referred to as autoscopes describe electronically controlled reticles having aiming marks that are displayed on an electronic display to correspond to a particular selected ammunition and range data. U.S. Pat. No. 6,269,581 of Groh is one example.

BRIEF DESCRIPTION OF THE DRAWINGS

FIG. 1 is a side elevation view of a riflescope mounted on a rifle in accordance with one embodiment.

FIG. 2 is a schematic diagram showing optical elements of a riflescope in accordance with one embodiment.

DETAILED DESCRIPTION OF EMBODIMENTS

Figure 3:
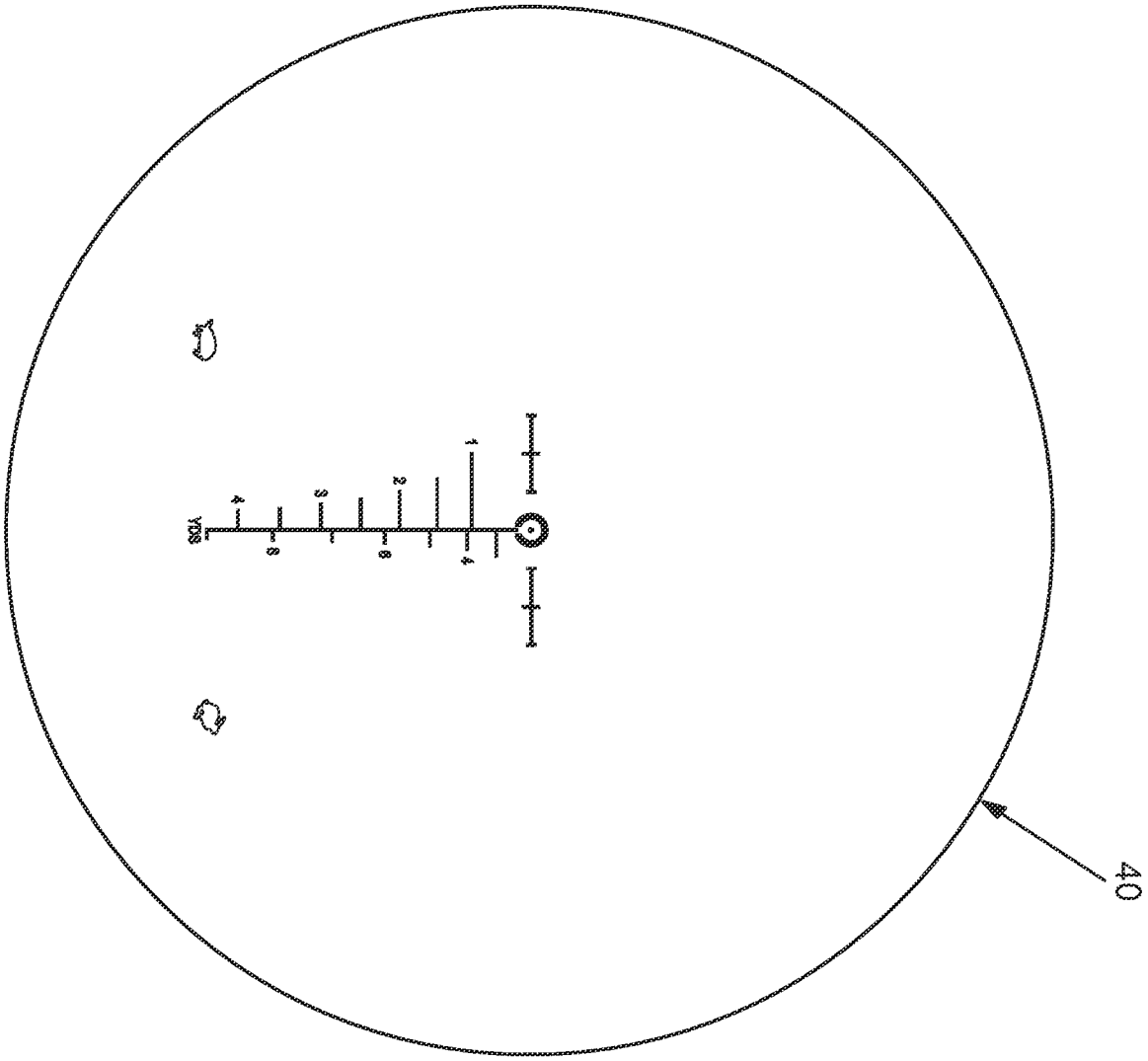
FIG. 3 is a view of a reticle in accordance with one embodiment as viewed through an ocular (eyepiece) of a riflescope.

FIG. 1 is a side elevation view of a riflescope 10 mounted to a rifle 14 in accordance with one embodiment. FIG. 2 is a schematic diagram showing an arrangement of optical elements 16 of riflescope 10, together with ray trace lines 18 indicating the path of light from an observed object (not shown) located to the left of the assembly of optical elements 16, as the light travels through the optical system along an optical path. Riflescope 10 includes a tubular housing 20 that supports at opposite ends an objective or objective lens assembly 22 and an ocular or ocular lens assembly 26 (sometimes referred to as an eyepiece or eyepiece lens assembly). Objective 22 focuses the image of an observed object at a first (front) focal plane 28 located medially of objective 22 and ocular 26. A power-adjusting erector lens assembly 30 interposed between objective 22 and ocular 26 inverts the image and refocuses it at a second (rear) focal plane 32 between erector lens assembly 30 and ocular 26. At least a part of erector lens assembly 30 is movable in response to rotation of a power selector ring 34 or other power selector mechanism to adjust the optical power of riflescope 10 within a predetermined range of magnification. For example, the optical power of riflescope 10 may range between approximately 1.5× and 5× magnification, in accordance with some embodiments. In other embodiments, the optical power of riflescope 10 may be fixed, or may be adjustable in various other magnification ranges.

A reticle 40 is preferably positioned or superimposed in a field of view in the optical path between objective 22 and erector lens assembly 30, at or adjacent first focal plane 28. Consequently, the angles subtended by aiming marks (described below) of reticle 40 are the same at any magnification. In another embodiment (not shown), the reticle is embodied in a transparent reticle disc located at rear focal plane 32 of riflescope 10, in which case the angles subtended by the aiming marks will vary with the magnification settings of riflescope 10.

By way of example, reticle 40 may be used in a riflescope 10 in a configuration of various riflescopes sold by Leupold & Stevens, Inc. of Beaverton, Oreg., USA under the trademarks Mark 8, Mark 6, VX®, and others. However, the reticle described herein is not limited to use in riflescopes or with rifles, but may also be used in various other types of sighting devices and projectile-weapon aiming devices and may be used to aim one or more of a variety of projectile weapons, such as rifles, pistols, crossbows, and others.

Figure 4:
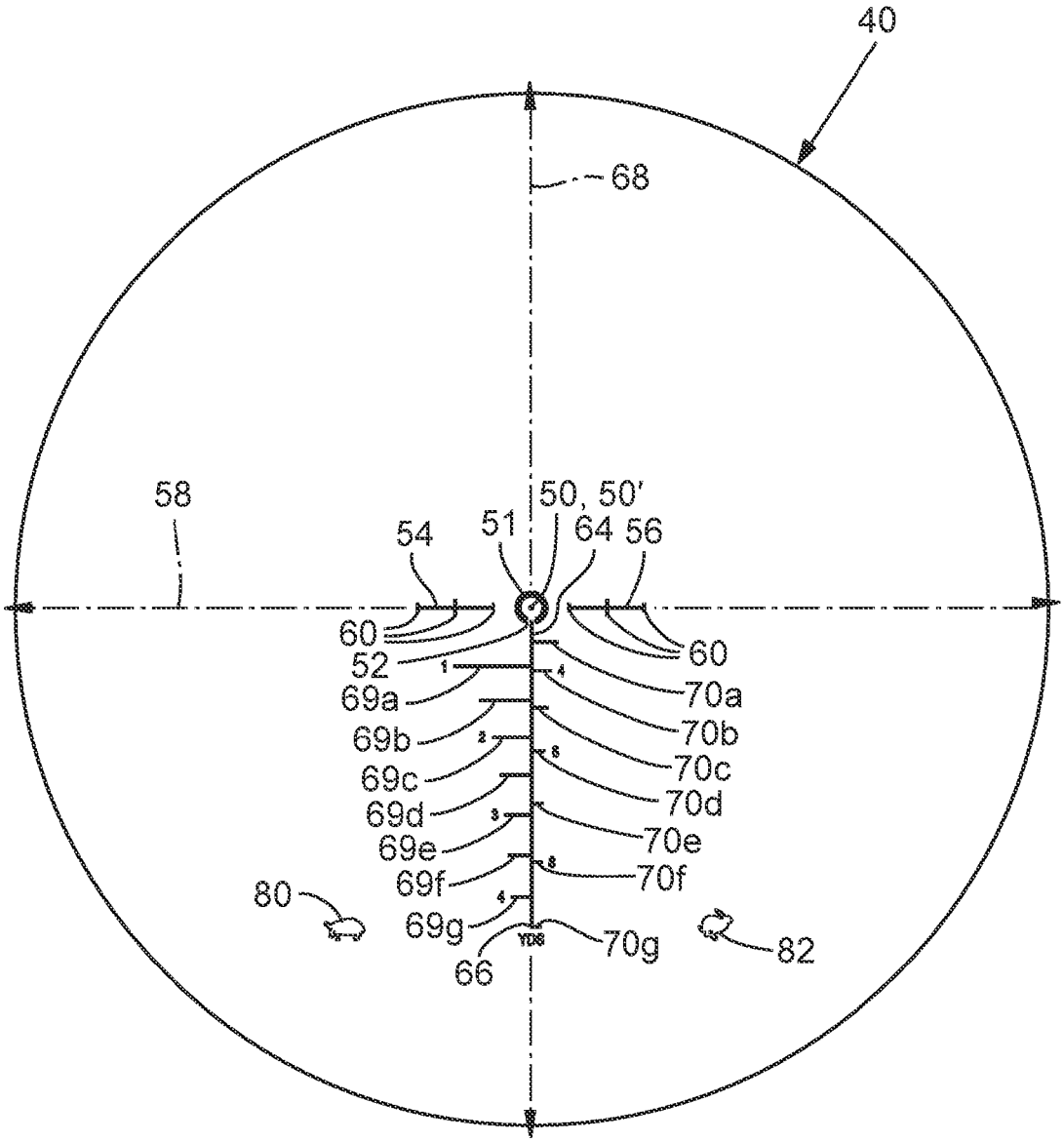
FIG. 4 is a view of the reticle of FIG. 3 including reference numerals referred to in the detailed description for describing the various features of the reticle.
Figure 5:
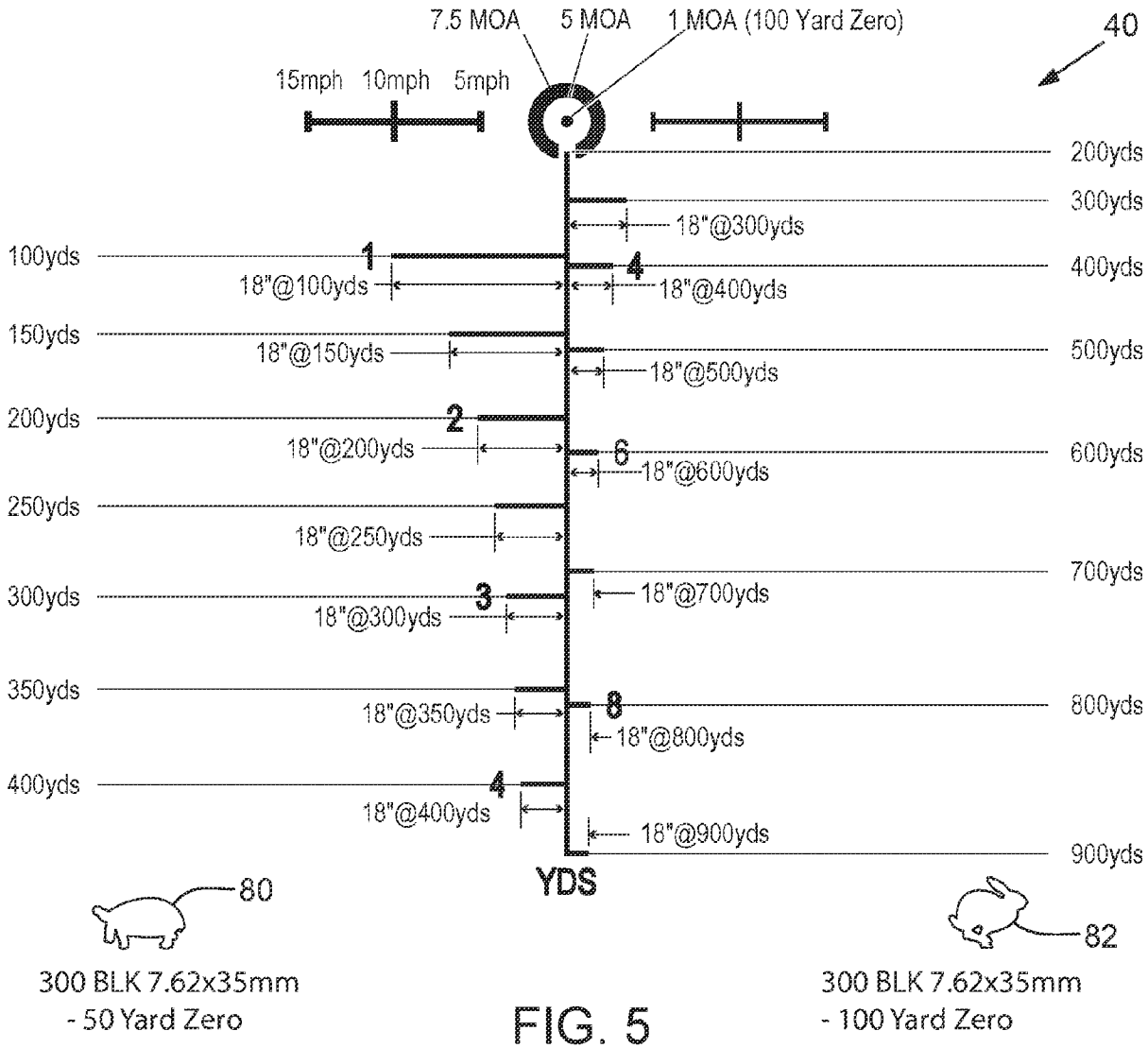
FIG. 5 is an enlarged view of the reticle of FIG. 3 including dimension lines referred to in the detailed description for describing the various features of the reticle.

FIG. 3 is a pictorial representation of reticle 40 as viewed through ocular 26 of riflescope 10. FIG. 4 is another pictorial view of reticle 40 that includes reference numbers referred to below, and FIG. 5 is an enlarged view of reticle 40 that includes dimension lines for the various aiming marks. According to the embodiment of FIGS. 3-5, the arrangement and selection of aiming marks of reticle 40 are suited to tactical shooting, in which hostile enemy targets are located at close or far range, the optical power range of riflescope 10 is moderate or low, and the weapon and riflescope combination may be sighted-in such that two types of ammunition can be aimed with the one reticle 40 without any adjustment to the sight or weapon. For example, as described in detail below, marks of reticle 40 provide two simultaneously visible series of aiming marks for both subsonic and supersonic 300 AAC Blackout ammunition.

Reticle 40 is preferably formed on a substantially flat disc of optical quality material, such as glass or plastic, and includes a primary aiming mark 50 coincident with and indicating a primary aiming point 50'. Mark 50 is a centrally located dot generally aligned with the optical center of riflescope 10, and having an outside diameter of 1 minute of angle (MOA) (FIG. 5). To draw a shooter's eye and help a shooter locate primary aiming point 50', mark 50 is partly encompassed by an aiming ring 51 with an inside diameter of 5 MOA, an outside diameter of 7.5 MOA, and an opening 52 on its bottom side.

A pair of primary horizontal sight lines 54 and 56 in the form of stadia lines at opposing sides of mark 50 collectively overlay a horizontal axis 58 that intersects primary aiming point 50'. Three hash marks 60 on each of horizontal sight lines 54 and 56 are used to lead targets moving at 5, 10, and 15 miles per hour (mph), as shown in FIG. 5. In other embodiments, kilometers per hour, MOA, or millimeters may be used as units of hash marks 60.

A primary vertical sight line 64 is a post (i.e., a stadia line), extending from opening 52 to a distal end 66, and overlaying a vertical axis 68 that intersects primary aiming point 50'. A series of seven left-side secondary aiming marks 69*a-g* (collectively, 69) are spaced below primary aiming point 50' and extend from the left side of vertical sight line 64. A series of seven right-side secondary aiming marks 70*a-g* (collectively, 70) are spaced below primary aiming point 50' and extend from the right side of vertical sight line 64.

Each series of secondary aiming marks 69 and 70 comprises tic marks positioned at progressively increasing distances below the primary aiming point 50'. In some embodiments, the first and second series of secondary aiming marks 69 and 70 are spaced apart by progressively increasing incremental distances. The first and second series of secondary aiming marks 69, 70 provide holdover aiming points for regularly incrementing target distances based on the parabolic flight of respective subsonic and supersonic .300 AAC Blackout ammunition. In other embodiments (not shown), secondary aiming marks need not touch primary vertical sight line 64 to indicate the location of holdover aiming points. Thus, depending on the design preference, the secondary aiming marks may or may not overlap with, contact, or extend through the vertical axis or a primary vertical sight line.

The secondary aiming marks 69 and 70 are spaced apart at distances from the primary aiming mark 50 preselected to compensate for bullet drop of respective ammunition at regularly incrementing target distances. For example, secondary aiming marks 69*a-g* are arranged for accurate indication of subsonic AAC ammunition bullet drop at incremental ranges of 50 yards when primary mark 50 is sighted-in at 50 yards for subsonic ammunition—i.e., when the optical alignment of riflescope 10 relative to a barrel 44 of rifle 14 (FIG. 1) is adjusted so that primary aiming mark 50 accurately indicates a point of bullet impact 50 yards from the shooter. Once sighted-in for the subsonic ammunition, mark 50 is already sighted-in at 100 yards for supersonic ammunition. Thus, secondary aiming marks 70*a-g* indicate points of impact for the supersonic ammunition at 100-yard increments up to a range of approximately 900 yards (assuming the shot is not affected by crosswinds or lateral drift). In another example, mark 50 is instead zeroed for supersonic ammunition at 100 yards, and per force zeroed for subsonic ammunition at 50 yards.

Combining secondary aiming marks for aiming two types of ammunition at incremental ranges makes it easy for a shooter to change loads, and avoids the need to re-sight (re-zero) riflescope 10 or otherwise adjust scope 10 or reticle 40 for the new ammunition type. For example, supersonic .300 AAC Blackout ammunition has a bullet weight of approximately 110-125 grains, and a muzzle velocity between approximately 650 meters per second (m/s) and approximately 732 m/s, while subsonic .300 AAC Blackout ammunition has a bullet weight of around 220 grains, and a muzzle velocity of approximately 310 m/s. Therefore, supersonic ammunition has a flatter parabolic flight path than that of subsonic ammunition, and consequently the right-side secondary aiming marks 70 mark distances greater than those of the left-side secondary aiming marks 69 at comparable holdover heights.

In the reticle 40, ranging fiducials shown as left-side numerals "1," "2," "3," "4" and right-side numerals "4," "6," "8" provide a visual indication and reminder of target distances (in units of hundreds of yards) for marks 69*a*, 69*c*, 69*e*, 69*g*, 70*b*, 70*d*, and 70*f*, respectively. Other units (e.g., meters) are also possible. Marks 69*g* and 70*b* have a common numeral fiducial "4" because marks 69*g* and 70*b* both indicate target distances of 400 yards. The marks 69*g* and 70*b* are spaced apart at different distances below primary aiming point 50' to provide holdover aiming points for two different types of ammunition, such as subsonic and supersonic ammunition, respectively.

Additionally, a tortoise fiducial 80 on the left side of reticle 40 provides a visual depiction that indicates marks 69 are for shooting subsonic ammunition, and a rabbit fiducial on the right side of reticle 40 provides a visual depiction that indicates that marks 70 are for shooting supersonic ammunition. Other embodiments may include text describing the ammunition types, or other visual depictions.

Reticle 40 includes range features for estimating range to a target of a predetermined size. To estimate range, a shooter attempts to determine which secondary aiming marks 69 or 70 most closely span an enemy soldier's shoulder-to-shoulder width, or other predetermined target size. In other words, the shooter matches the target width to a length of a secondary aiming mark, or to an estimated interpolated length between a pair of adjacent marks (e.g., 69*a* and 69*b*). The shooter knows the target distances that correspond to each of secondary aiming marks 69 and 70 from the fiducials, so that the shooter can determine an estimate of the target distance based on the target distances of a secondary aiming mark overlying the target width. For example, a soldier's shoulder-to-shoulder width is approximately 18 inches so that when the soldier is located 400 yards away from the shooter, the width spanned by the length of either mark 69*g* or 70*b* will approximately equal the soldier's shoulder-to-shoulder width when observed through riflescope 10.

Mark 50, ring 51, primary sight lines 54 and 56, and other indicia, described above, may be marked on the surface of a transparent reticle disc. They may also be embodied in other forms, such as reticle wires, iron sights, illuminated reticle devices, projected targeting displays, head-up displays, holographic displays, simulated reticle images, and the like. For example, in one embodiment, mark 50 and ring 51 are optionally illuminated. Thus, the terms reticle, mark, marking, marks, lines, and the like are not limited to permanent inscriptions on a physical object, but are intended to also include all kinds of visually perceptible patterns, signs, and symbols, regardless of the way in which they are created and regardless of whether their elements are permanent or transitory in nature, or a combination of both permanent and transitory elements.

Projectile-weapon aiming systems have been described herein principally with reference to their use with rifles and embodied as riflescopes. However, skilled persons will understand that projectile-weapon aiming systems may include aiming devices other than riflescopes, which are capable of propelling projectiles along substantially predeterminable trajectories. Thus, it will be obvious to skilled persons that many changes may be made to the details of the above-described embodiments without departing from the underlying principles of the invention. The scope of the present invention should, therefore, be determined only by the following claims.

The invention claimed is:

1. A reticle for a sighting device mountable to a rifle selectively firing a subsonic ammunition and a supersonic ammunition, the reticle comprising:

a primary aiming mark providing a first supersonic aiming point for zeroing the supersonic ammunition at a first predetermined target range;

a first secondary aiming mark located at a first distance below the primary aiming mark, the first secondary aiming mark providing a first subsonic aiming point for firing the subsonic ammunition at a second predetermined target range;

a subsonic indicator numeral that indicates range according to at least one of yards or meters, associated with the first secondary aiming mark, appearing on one of a left side or a right side of a field of view of the sighting device when the reticle is installed therein;

a second secondary aiming mark located below the first secondary aiming mark at a second distance that is different from the first distance and below the primary aiming mark, the second secondary aiming mark providing a second supersonic aiming point for firing the supersonic ammunition at a third predetermined target range that is greater than the second predetermined target range; and a supersonic indicator numeral that indicates range according to at least one of yards or meters, associated with the second secondary aiming mark, appearing on the other one of the left side or the right side of the field of view of the sighting device when the reticle is installed therein.

2. The reticle of claim 1, further comprising a third secondary aiming mark located at a third distance below the primary aiming mark and between the primary aiming mark and the first secondary aiming mark.

3. The reticle of claim 1, further comprising a third secondary aiming mark located at a third distance below the primary aiming mark and between the primary aiming mark and the first secondary aiming mark, in which the third secondary aiming mark includes a surface of a vertical line aiming mark.

4. The reticle of claim 3, in which the third secondary aiming mark provides a third supersonic aiming point for firing the supersonic ammunition at a third predetermined target range that is greater than the second predetermined target range.

5. The reticle of claim 1, in which the subsonic indicator numeral includes a first numeral equal to a first digit of a range value equal to the second predetermined target range.

6. The reticle of claim 1, in which the supersonic indicator numeral is a numeral equal to a first digit of a range value equal to the third predetermined target range.

7. The reticle of claim 1, in which the one of the left side or the right side is the left side.

8. The reticle of claim 1, in which the supersonic indicator numeral implies a range value corresponding to the third predetermined target range.

9. The reticle of claim 1, in which the second secondary aiming mark indicates at least one of a 400-yard or 400-meter aiming point.

10. The reticle of claim 1, in which the primary aiming mark indicates at least one of a 100-yard or 100-meter aiming point.

11. The reticle of claim 1, further comprising an aiming mark indicating at least one of a 50-yard or 50-meter aiming point.

12. A riflescope including the reticle of claim 1.

13. A reticle for a sighting device mountable to a rifle selectively firing a subsonic ammunition and a supersonic ammunition, the reticle comprising:

a first aiming mark providing a first aiming point for zeroing the supersonic ammunition at a first predetermined target range;

a second aiming mark located below the first aiming mark, the second aiming mark providing a second aiming point for firing the supersonic ammunition at a second predetermined target range that is greater than the first predetermined target range;

a third aiming mark located below the second aiming mark, the third aiming mark providing a third aiming point for firing the subsonic ammunition at the first predetermined target range;

a fourth aiming mark located below the third aiming mark, the fourth aiming mark providing a fourth aiming point for firing the subsonic ammunition at the second predetermined target range;

a subsonic indication on a first lateral side of a field of view of the sighting device when the reticle is installed therein; and a supersonic indication on a second lateral side of the field of view opposite the first lateral side.

14. The reticle of claim 13, in which:

the subsonic indication comprises a first set of numerals; and the supersonic indication comprises a second set of numerals.

15. The reticle of claim 13, in which the first side is a left side.

16. The reticle of claim 13, in which the subsonic indication comprises a subsonic range numeral that appears on a left side of a field of view of the sighting device when the reticle is installed therein.

17. The reticle of claim 13, in which the supersonic indication comprises numerals appearing on a right side of a field of view of the sighting device when the reticle is installed therein that indicate target ranges for aiming marks associated with the supersonic ammunition.

18. The reticle of claim 13, in which the second aiming mark indicates at least one of a 200-yard or 200-meter aiming point.

19. The reticle of claim 13, in which the third aiming mark indicates at least one of a 100-yard or 100-meter aiming point.

20. The reticle of claim 13, in which the fourth aiming mark indicates at least one of a 200-yard or 200-meter aiming point.

21. The reticle of claim 13, in which the second aiming mark is defined by a first shape, and in which the third aiming mark is defined by a second shape that is different than the first shape.

22. A riflescope including the reticle of claim 13.

23. A reticle for a sighting device mountable to a rifle selectively firing a subsonic ammunition and a supersonic ammunition, the reticle comprising:

a primary aiming mark providing a zero aiming point for the supersonic ammunition;

a plurality of secondary aiming marks arranged in line along a vertical axis below the primary aiming mark;

a plurality of subsonic indicator numerals on a first lateral side of the vertical axis, each one of the plurality of subsonic indicator numerals being:

arranged at a different distance below the primary aiming mark, proximate a corresponding aiming mark of the plurality of secondary aiming marks, and indicative of a predetermined target range for subsonic ammunition; and a plurality of supersonic indicator numerals on a second lateral side of the vertical axis opposite the first lateral side, each one of the plurality of supersonic indicator numerals being:

arranged at a different distance below the primary aiming mark, proximate a corresponding aiming mark of the plurality of secondary aiming marks, and indicative of a predetermined target range for supersonic ammunition.

24. The reticle of claim 23, in which the plurality of subsonic indicator numerals are arranged on a left side of the vertical axis and the plurality of supersonic indicator numerals are arranged on a right side of the vertical axis.

25. The reticle of claim 23, in which the secondary aiming marks corresponding to the subsonic indicator numerals are distinct from the secondary aiming marks corresponding to the supersonic indicator numerals.

26. The reticle of claim 23, in which the plurality of supersonic indicator numerals comprise:

a first supersonic numeric indicator indicating at least one of a 400-yard or 400-meter target range; and a second supersonic numeric indicator indicating at least one of a 600-yard or 600-meter target range.

* * * * *